US009896902B2

(12) United States Patent
Stoisits et al.

(10) Patent No.: US 9,896,902 B2
(45) Date of Patent: Feb. 20, 2018

(54) INJECTING A HYDRATE SLURRY INTO A RESERVOIR

(71) Applicants: Richard F. Stoisits, Kingwood, TX (US); Larry D. Talley, Friendswood, TX (US); Jason W. Lachance, Pearland, TX (US); Douglas J. Turner, Humble, TX (US)

(72) Inventors: Richard F. Stoisits, Kingwood, TX (US); Larry D. Talley, Friendswood, TX (US); Jason W. Lachance, Pearland, TX (US); Douglas J. Turner, Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 800 days.

(21) Appl. No.: 13/874,938

(22) Filed: May 1, 2013

(65) Prior Publication Data

US 2013/0312980 A1 Nov. 28, 2013

Related U.S. Application Data

(60) Provisional application No. 61/651,810, filed on May 25, 2012.

(51) Int. Cl.

| | |
|---|---|
| ***F15D 1/00*** | (2006.01) |
| ***E21B 43/16*** | (2006.01) |
| ***E21B 43/01*** | (2006.01) |
| ***F16C 11/00*** | (2006.01) |
| ***E21B 33/13*** | (2006.01) |

(52) U.S. Cl.
CPC ..... *E21B 33/13* (2013.01); *E21B 43/166* (2013.01)

(58) Field of Classification Search
None
See application file for complete search history.

(56) References Cited

U.S. PATENT DOCUMENTS

| | | | | |
|---|---|---|---|---|
| 4,697,426 | A | 10/1987 | Knowles, Jr. | |
| 5,421,408 | A * | 6/1995 | Stoisits | E21B 33/068 166/268 |
| 6,245,955 | B1 * | 6/2001 | Smith | C10L 3/00 585/15 |
| 6,774,276 | B1 * | 8/2004 | Lund et al. | 585/899 |
| 7,261,810 | B2 | 8/2007 | Argo et al. | |
| 7,686,086 | B2 * | 3/2010 | Brammer | 166/357 |
| 7,703,535 | B2 | 4/2010 | Benson | |

(Continued)

OTHER PUBLICATIONS

Attanucci, V., et al., (1993) "WAG Process Optimization in the Rangely $CO_2$ Miscible Flood", *SPE 26622*, SPE 68$^{th}$ Annual Technical Conference, Oct. 1993, pp. 141-154.

(Continued)

*Primary Examiner* — Matthew R Buck
*Assistant Examiner* — Douglas S Wood
(74) *Attorney, Agent, or Firm* — ExxonMobil Upstream Research Company—Law Department

(57) ABSTRACT

A method and systems are provided for injecting a hydrate slurry into a reservoir. The method includes combining gas and water within a subsea simultaneous water and gas (SWAG) injection system. The method also includes forming a hydrate slurry from the gas and the water, and injecting the hydrate slurry into a reservoir.

25 Claims, 9 Drawing Sheets

(56) References Cited

U.S. PATENT DOCUMENTS

| | | | | |
|---|---|---|---|---|
| 7,731,843 | B2 * | 6/2010 | Pinchin | C02F 1/688 166/266 |
| 7,931,082 | B2 * | 4/2011 | Surjaatmadja | E21B 43/017 166/268 |
| 7,963,335 | B2 * | 6/2011 | Krehbiel | E21B 43/122 166/335 |
| 2010/0012325 | A1 | 1/2010 | Friedemann | |
| 2011/0308625 | A1 * | 12/2011 | Stoisits | C09K 8/52 137/1 |

OTHER PUBLICATIONS

Berge, L.I., et al., (2002) "SWAG Injectivity Behavior Base on Siri Field Data", *SPE 75126*, presented at the 2002 SPE/DOE Improved Oil Recovery Symposium, Tulsa, Apr. 13-17, pp. 1-8.

Champion, J.H., et al., (1989) "An Immiscible WAG (Water-Alternating-Gas) Injection Project in the Kuparuk River Unit," *Journal of Petroleum Technology,* May, pp. 533-540.

Gudmundsson, J.S., (2002) "Cold Flow Hydrate Technology", *4th International Conference on Gas Hydrates,* May 19-23, 5 pages.

Larsen, R., et al. (2008) "Flow Assurance Capabilities Statement—Saturn Cold Flow", *SINTEF Petroleum Research* , Norway, Oct.

Ma, T.D., et al., (1994) "Performance of Immiscible Water-Alternating-Gas (IWAG) Injection at Kuparuk River Unit, North Slope, Alaska", *SPE 28602,* pp. 415-423.

Ma, T.D., et al., (1995) "Simultaneous Water and Gas Injection Pilot at the Kuparuk River Field, Reservoir Impact", *SPE 30726,* pp. 259-266.

Quale, E.A., et al., (2000) "SWAG Injection on the Siri Field—An Optimized Injection System for Less Cost", *SPE 65165,* pp. 1-9.

Stephenson, D.J., et al., (1993) "Mobility Control Experience in the Joffre Viking Miscible $CO_2$ Flood", SPE Reservoir Engineering, Aug., pp. 183-188.

van Ligen, P.P., et al., (1996) "WAG Injection to Reduce Capillary Entrapment in Small-Scale Heterogeneities", *SPE 36662,* pp. 771-777.

* cited by examiner

100

200

200

400

500

600

700

800

900

INJECTING A HYDRATE SLURRY INTO A RESERVOIR

CROSS-REFERENCE TO RELATED APPLICATION

This application claims the benefit of U.S. Provisional Patent Application 61/651,810 filed May 25, 2012 entitled INJECTING A HYDRATE SLURRY INTO A RESERVOIR, the entirety of which is incorporated by reference herein.

FIELD OF THE INVENTION

The present techniques relate to the injection of a hydrate slurry into a reservoir in order to maintain a pressure within the reservoir. Specifically, techniques are disclosed for the injection of a hydrate slurry into a reservoir using a simultaneous water and gas (SWAG) injection system.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Water injection and gas injection are routinely used in oil and gas production fields to replace voidage in order to maintain reservoir pressure. Often the water and gas are injected in the same injection well. If both are injected, the process often involves alternating water and gas injection service of the well. The alternating injection is often referred to as Water-Alternating-Gas, or WAG, injection. WAG injection is an effective process for maintaining reservoir pressure, and has in many cases increased production and recovery over dedicated water injection only wells and gas injection only wells. Further, the effectiveness of WAG injection can often be improved by minimizing the time period for water and gas injection in a given well. This may be achieved by simultaneously injecting water and gas in the well. This process is often referred to as Simultaneous Water and Gas, or SWAG, injection. SWAG injection can improve water and gas management and reduce the capital cost of the injection system.

Immiscible WAG injection has been effectively used to manage produced gas at the Kuparuk River Unit, boosting the field rate and recovery. In Champion, et al., "An Immiscible WAG (Water-Alternating-Gas) Injection Project in the Kuparuk River Unit," 1989, it was shown that trapped gas would alter reservoir fluid mobilities and result in improved waterflood sweep efficiency. In Ma, et al., "Performance of Immiscible Water-Alternating-Gas (IWAG) Injection at the Kuparuk River Unit, North Slope, Alaska," 1994, other benefits of such trapped gas were observed, such as higher production rates, reduced water handling costs, and increased pressure support.

SWAG injection was identified as an option that could reduce capital and operating costs and improve gas handling and oil recovery. In Attanucci, et al., "WAG Process Optimization in the Rangely Carbon Dioxide Miscible Flood", 1993, improved gas handling and oil recovery were reported for SWAG injection at the Joffre Viking $CO_2$ miscible flood and SWAG emulation at the Rangely $CO_2$ miscible flood.

Results of the mobility control test at Joffre Viking $CO_2$ miscible flood indicated that simultaneous $CO_2$ and water injection at water/$CO_2$ ratios approaching 1 resulted in improved sweep compared with Water-Alternating-$CO_2$ injection and continuous $CO_2$ injection. Dual tubing strings were installed in the SWAG well. In addition, results of the WAG process optimization at the Rangely $CO_2$ miscible flood indicated that reducing half-cycle lengths had the potential to increase the efficiency of the $CO_2$ recovery process, add incremental reserves, and improve lift efficiencies, resulting in reduced operating costs. For optimal net present values, the average half-cycles were reduced from 1.5% to 0.25% hydrocarbon pore volume (HCPV).

In Ma, et al., "Simultaneous Water and Gas Injection Pilot at the Kuparuk River Field, Reservoir Impact", 1995, the application of the SWAG process to the Kuparuk River Unit was evaluated using reservoir simulations. Simulation analyses were conducted to estimate the benefits of SWAG injection at a water to gas ratio of 10:1, corresponding to a gas-liquid ratio of 120 SCF per barrel. The 10:1 SWAG ratio was designed to achieve dispersed bubble flow. Sensitivity studies were also made to evaluate the benefits of a 1:1 SWAG ratio and a 1:1 Immiscible Water-Alternating Gas, or IWAG, ratio. The 10:1 SWAG case yielded an incremental oil recovery of 2.2% of the original oil-in-place (OOIP) over waterflood. This corresponded to a total gas slug of only 10% HCPV. SWAG injection resulted in depressed watercuts. The normal IWAG injection at 1:1 water to gas ratio yielded an incremental recovery of 4.5% OOIP. SWAG injection at 1:1 water to gas ratio yielded the highest incremental recovery of 5.0% OOIP.

In Van Ligen, et al., "WAG Injection to Reduce Capillary Entrapment in Small-Scale Heterogeneities", 1996, an experimental study of SWAG injection was performed as a means to reduce the capillary entrapment of oil. Six experiments were conducted using three heterogeneity geometries. The results indicated that SWAG injection results in significantly higher displacement efficiency than water injection.

In Quale, et al., "SWAG Injection on the Siri Field—An Optimized Injection System for Less Cost", 2000, and Berge, et al., "SWAG Injectivity Behavior Base on Siri Field Data", 2002, the successful implementation of SWAG at the Siri Field in the North Sea was reported. The associated produced gas is mixed with injection water at the wellhead, and injected as a two-phase mixture. The total injection volume desired for voidage replacement is achieved with a simplified injection system, fewer wells and reduced gas recompression pressure requirements. In addition, SWAG injection is estimated to yield an incremental recovery of 6% over water injection.

Conventionally, WAG systems have been used for pressure maintenance in a reservoir. Typically, for a subsea operation, this involves bringing a multiphase flow production stream to a topsides facility, separating and recompressing the gas, and then sending the gas back to a subsea reservoir. In addition, according to current SWAG injection systems, a multiphase flow production stream is brought to a topsides facility. The gas is then separated from the multiphase flow production stream, recompressed, and sent back through an injection line to the reservoir. However, bringing the multiphase flow production stream all the way to shore or to a topside facility often results in high capital and operating expenditures.

SUMMARY

An embodiment of the present techniques provides a method for injecting a hydrate slurry into a reservoir. The method includes combining gas and water within a subsea simultaneous water and gas (SWAG) injection system. The method also includes forming a hydrate slurry from the gas and the water, and injecting the hydrate slurry into a reservoir.

Another embodiment provides a system for maintaining pressure within a reservoir using a subsea simultaneous water and gas (SWAG) injection system. The system includes a subsea separation system configured to separate gas from production fluids and flow the gas into a hydrate generator. The system includes a water injector configured to inject water into the hydrate generator, wherein the hydrate generator is configured to form a hydrate slurry from the gas and the water. The system also includes an injection well configured to inject the hydrate slurry into a reservoir.

Another embodiment provides a method for maintaining pressure within a reservoir using a water continuous hydrate slurry that is generated in a subsea environment. The method includes combining gas and water within a hydrate generator to generate the water continuous hydrate slurry in the subsea environment. The method also includes injecting the water continuous hydrate slurry into the reservoir to effect a maintenance of pressure within the reservoir.

BRIEF DESCRIPTION OF THE DRAWINGS

The advantages of the present techniques are better understood by referring to the following detailed description and the attached drawings, in which.

DETAILED DESCRIPTION

Figure 1:
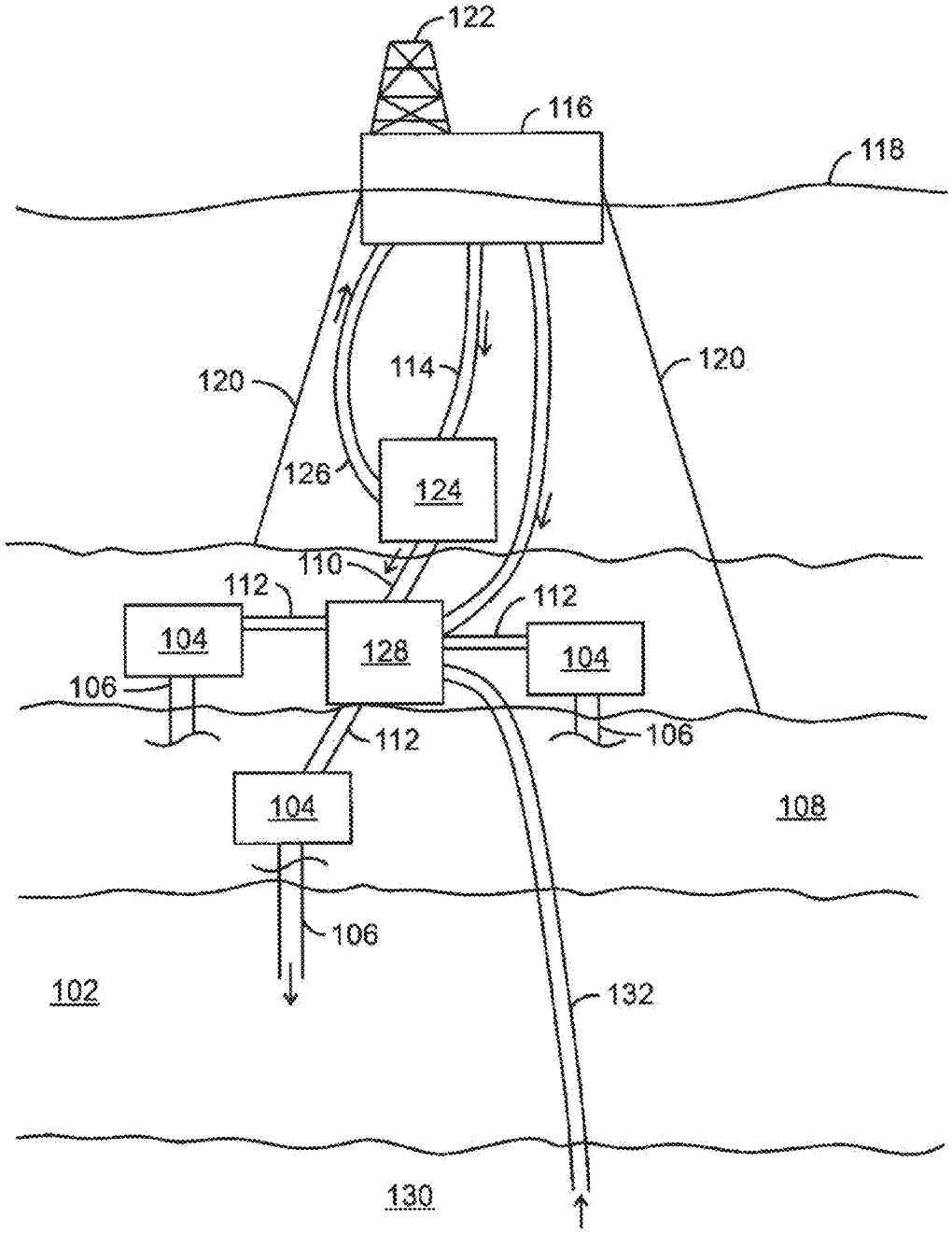
FIG. 1 is an illustration of a subsea hydrocarbon field in which a simultaneous water and gas (SWAG) injection process may be performed in order to maintain a pressure within a reservoir.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Exemplary" is used exclusively herein to mean "serving as an example, instance, or illustration." Any embodiment described herein as "exemplary" is not to be construed as preferred or advantageous over other embodiments.

A "facility" as used herein is a representation of a tangible piece of physical equipment through which hydrocarbon fluids are either produced from a reservoir or injected into a reservoir. In its broadest sense, the term facility is applied to any equipment that may be present along the flow path between a reservoir and the destination for a hydrocarbon product. Facilities may include production wells, injection wells, well tubulars, wellhead equipment, gathering lines, manifolds, pumps, compressors, separators, surface flow lines, and delivery outlets. In some instances, the term "surface facility" is used to distinguish those facilities other than wells. A "facility network" is the complete collection of facilities that are present in the model, which would include all wells and the surface facilities between the wellheads and the delivery outlets. One type of facility is a "production center." As used herein, a production center includes the wells, wellheads, and other equipment associated with the initial production of a hydrocarbon and the formation of a transportation stream for bringing the hydrocarbon to the surface.

A "formation" is any finite subsurface region. The formation may contain one or more hydrocarbon-containing layers, one or more non-hydrocarbon containing layers, an overburden, and/or an underburden of any subsurface geologic formation. An "overburden" and/or an "underburden" is geological material above or below the formation of interest.

The term "FSO" refers to a Floating Storage and Offloading vessel, which may be considered to be one type of surface facility. A floating storage device, usually for oil, is commonly used where it is not possible or efficient to lay a pipe-line to the shore. A production platform can transfer hydrocarbons to the FSO where they can be stored until a tanker arrives and connects to the FSO to offload it. The FSO may also contain production facilities. A FSO may include a liquefied natural gas (LNG) production platform or any other floating facility designed to process and store a hydrocarbon prior to shipping.

The term "gas" is used interchangeably with "vapor," and means a substance or mixture of substances in the gaseous state as distinguished from the liquid or solid state. Likewise, the term "liquid" means a substance or mixture of substances in the liquid state as distinguished from the gas or solid state. As used herein, "fluid" is a generic term that may include either a gas or vapor.

As used herein, a "hydrate" is a composite made of a host compound that forms a basic framework and a guest compound that is held in the host framework by inter-molecular interaction, such as hydrogen bonding, Van der Waals forces, and the like. Hydrates may also be called host-guest complexes, inclusion compounds, and adducts. As used herein, "clathrate," "clathrate hydrate," and "hydrate" are interchangeable terms used to indicate a hydrate having a basic framework made from water as the host compound. A hydrate is a crystalline solid which looks like ice and forms when water molecules form a cage-like structure around a "hydrate-forming constituent."

A "hydrate-forming constituent" refers to a compound or molecule in petroleum fluids, including natural gas, that forms hydrate at elevated pressures and/or reduced temperatures. Illustrative hydrate-forming constituents include, but are not limited to, hydrocarbons such as methane, ethane, propane, butane, neopentane, ethylene, propylene, isobutylene, cyclopropane, cyclobutane, cyclopentane, cyclohexane, and benzene, among others. Hydrate-forming constituents can also include non-hydrocarbons, such as oxygen, nitrogen, hydrogen sulfide, carbon dioxide, sulfur dioxide, and chlorine, among others.

A "hydrocarbon" is an organic compound that primarily includes the elements hydrogen and carbon although nitrogen, sulfur, oxygen, metals, or any number of other elements may be present in small amounts. As used herein, hydrocarbons generally refer to organic materials that are transported by pipeline, such as any form of natural gas or oil. A "hydrocarbon stream" is a stream enriched in hydrocarbons by the removal of other materials such as water and/or THI. The hydrocarbons may include paraffins, which are alkanes having a general chemical formula of $C_nH_{2n+2}$. In paraffins, n is often about 20 to about 40. The paraffins may form solid deposits which may be referred to as "wax deposits" herein. Other chemical components may also be included in the wax deposits. The temperature at which wax deposits start to form may be termed the "wax appearance temperature" or the WAT.

The term "natural gas" refers to a multi-component gas obtained from a crude oil well (termed associated gas) or from a subterranean gas-bearing formation (termed non-associated gas). The composition and pressure of natural gas can vary significantly. A typical natural gas stream contains methane ($CH_4$) as a significant component. Raw natural gas will also typically contain ethylene ($C_2H_4$), ethane ($C_2H_6$), other hydrocarbons, one or more acid gases (such as carbon dioxide, hydrogen sulfide, carbonyl sulfide, carbon disulfide, and mercaptans), and minor amounts of contaminants such as water, nitrogen, iron sulfide, wax, and crude oil.

"Pressure" is the force exerted per unit area by the gas on the walls of the volume. Pressure can be shown as pounds per square inch (psi). "Atmospheric pressure" refers to the local pressure of the air. "Absolute pressure" (psia) refers to the sum of the atmospheric pressure (14.7 psia at standard conditions) plus the gage pressure (psig). "Gauge pressure" (psig) refers to the pressure measured by a gauge, which indicates only the pressure exceeding the local atmospheric pressure (i.e., a gauge pressure of 0 psig corresponds to an absolute pressure of 14.7 psia).

"Production stream," or "production fluid," refers to a liquid and/or gaseous stream removed from a subsurface formation, such as an organic-rich rock formation. Production streams may include both hydrocarbon fluids and non-hydrocarbon fluids. For example, production streams may include, but are not limited to, oil, natural gas and water.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

A "static mixer" is an apparatus for mixing liquids and/or gases, wherein the mixing is not accomplished through motion of the apparatus, but through the motion of the liquid and/or gas. A static mixer may help to reduce droplet sizes within the liquids and gases, and, thus, may assist in the formation and maintenance of emulsions and slurries.

"Thermodynamic hydrate inhibitor" refers to compounds or mixtures capable of reducing the hydrate formation temperature in a petroleum fluid that is either liquid or gas phase. For example, the minimum effective operating temperature of a petroleum fluid can be reduced by at least 1.5° C., 3° C., 6° C., 12° C., or 25° C., due to the addition of one or more thermodynamic hydrate inhibitors. Generally the THI is added to a system in an amount sufficient to prevent the formation of any hydrate.

"Well" or "wellbore" refers to a hole in the subsurface made by drilling or insertion of a conduit into the subsurface. The terms are interchangeable when referring to an opening in the formation. A well may have a substantially circular cross section, or other cross-sectional shapes (for example, circles, ovals, squares, rectangles, triangles, slits, or other regular or irregular shapes). Wells may be cased, cased and cemented, or open-hole well, and may be any type, including, but not limited to a producing well, an experimental well, an exploratory well, or the like. A well may be vertical, horizontal, or any angle between vertical and horizontal (a deviated well), for example a vertical well may comprise a non-vertical component.

Overview

The temperature and pressure in a SWAG injection process may often be in a region that is conducive to gas hydrate formation. Gas hydrates, or hydrates, are solids that can potentially form an obstruction in an injection well, or the lines leading to the injection well, thereby disabling the injection process. In order to prevent plugging of the injection system, the hydrate particles are formed into a slurry in a manner which prevents the hydrate particles from adhering to each other. Such a hydrate slurry may be referred to as a "cold flow hydrate slurry."

Embodiments described herein relate generally to the application of cold flow hydrates in a SWAG injection process. In the conventional SWAG injection process, the injection fluid includes water and gas that is susceptible to the formation of hydrates. In the Cold Flow SWAG, or CF-SWAG, injection process described herein, the injection fluid includes water and cold flow hydrates. The CF-SWAG injection process enables the implementation of the SWAG injection process in the region where pressures and temperatures would normally generate obstruction-forming hydrates. In some instances, specialized equipment may not be used to generate the cold flow hydrates of the CF-SWAG injection process. However, in other instances, specialized equipment such as a jet pump nozzle may be used to create the appropriate conditions for generating cold flow hydrates. The water within the jet pump may have a high pressure and, thus, may be used to provide power, while the gas may have a low pressure. Gas may be drawn into the nozzle and subjected to high shear forces generated by the high-pressure water. The resulting fluid is water with cold flow hydrates, which may be injected into the reservoir.

As discussed above, according to current WAG injection systems and SWAG injection systems, the multiphase flow production stream is brought all the way to shore or to a topside facility, which often results in high capital and operating expenditures. However, the CF-SWAG injection process described herein may be implemented without bringing the gas all the way to shore or to a treating facility. In other words, the CF-SWAG injection process may be performed locally without using subsea compression.

Exemplary Subsea Hydrocarbon Field

FIG. 1 is an illustration of a subsea hydrocarbon field 100 in which a simultaneous water and gas (SWAG) injection process may be performed in order to maintain a pressure within a reservoir 102. As shown in FIG. 1, the hydrocarbon field 100 can have a number of wellheads 104 coupled to injection wells 106 that are configured to simultaneously inject water and gas into a reservoir 102. The wellheads 104 may be located on the ocean floor 108. Each of the injection wells 106 may include single wellbores or multiple, branch wellbores. Each of the wellheads 104 can be coupled to a central pipeline 110 by gathering lines 112. In some embodiments, the central pipeline 110 may continue through the field 100, coupling to further wellheads (not shown). A flexible line 114 may couple the central pipeline 110 to a surface facility 116 at the ocean surface 118. The surface facility 116 may be, for example, a floating processing station, such as a floating storage and offloading unit (or FSO), that is anchored to the ocean floor 108 by a number of tethers 120. The surface facility 116 may also be a drilling platform that includes drilling equipment, such as a tower or derrick 122. The surface facility 116 may transport processed hydrocarbons to shore facilities by pipeline (not shown).

In various embodiments, production fluids from a wellhead (not shown) or manifold (not shown) may be flowed into a separation system 124 through the flexible line 114. Within the separation system 124, the production fluids may be separated into a liquid stream and a gas stream. The liquid stream may then be sent to the surface facility 116 via a flexible line 126.

The gas that is separated from the production fluids may be flowed into a hydrate generator 128 via the central pipeline 110. In addition, water may be obtained from an aquifer 130 via a line 132, and injected into the hydrate generator 128. In various embodiments, water may also be injected into the hydrate generator 128 from a number of other sources. For example, local seawater that has been treated and processed at a facility may be injected into the hydrate generator 128.

The gas and the water may be mixed together within the hydrate generator 128 using, for example, static mixers or a jet pump, in order to generate a water continuous hydrate slurry. The hydrate slurry may then be injected into the reservoir 102 via the injection wells 106. The injection of the hydrate slurry into the reservoir 102 can maintain, or increase, the pressure within the reservoir 102.

SWAG Injection System

Figure 2:
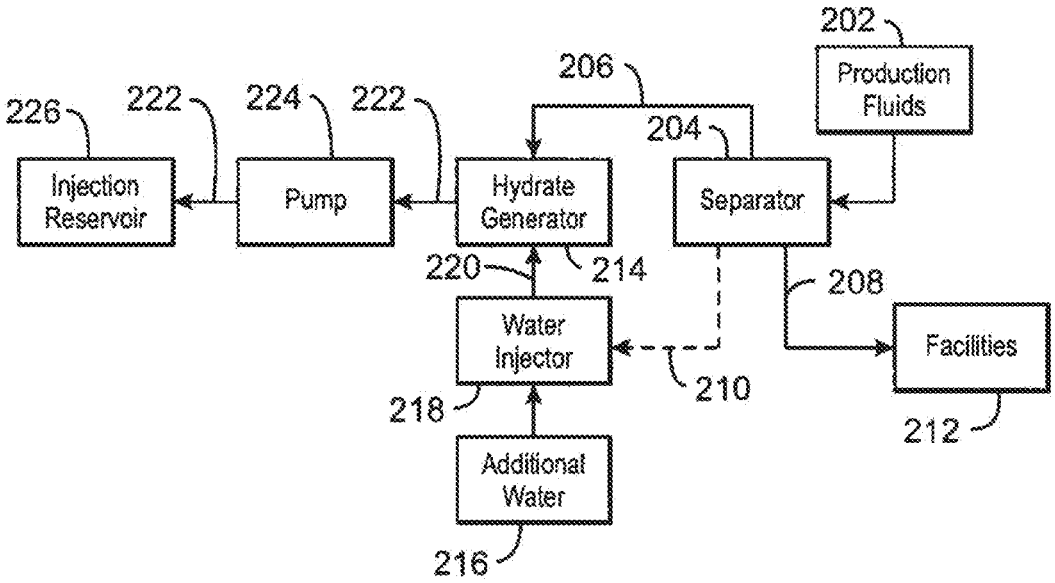
FIG. 2 is a block diagram of a SWAG injection system that may be utilized to inject a hydrate slurry into a reservoir.

FIG. 2 is a block diagram of a SWAG injection system 200 that may be utilized to inject a hydrate slurry into a reservoir. In various embodiments, the SWAG injection system 200 may be configured to inject water and gas into a reservoir simultaneously by creating a water continuous hydrate slurry. As shown in FIG. 2, wellhead or manifold fluids, e.g., production fluids 202, produced from a reservoir may be sent to a separator 204. The separator 204 may be a two-phase separator or a three-phase separator, depending on the specific application. Within the separator 204, the production fluids 202 may be separated into a gas stream 206 and an oil stream 208. In addition, some amount of water 210 may be isolated from the production fluids 202 within the separator 204. The oil stream 208 may then be sent to a facility 212 for further processing.

A portion of the gas stream 206 may be sent from the separator 204 to a hydrate generator 214 in the SWAG manifold. If water 210 has been separated from the production fluids 202, the water 210 can be combined with additional water 216 to be injected within a water injector 218. The additional water 216 to be injected may come from various sources. One source of the additional water 216 may be local seawater, which may be injected using a subsea water treatment skid that removes oxygen and destroys bacteria or other organisms in the water 216. Another potential source of the additional water 216 may be water that has been treated and combined with produced water at a facility. In addition, the additional water 216 may be obtained from a local aquifer.

The mixing of the water 210 and the additional water 216 within the water injector 218 provides a water stream 220. The water injector 218 may inject the water stream 220 into the hydrate generator 214 in the SWAG manifold.

Within the hydrate generator 214, the water stream 220 and the gas stream 206 may be turbulently mixed in order to produce a hydrate slurry 222. The generation of the hydrate slurry 222 may be accomplished using a jet pump, static mixers, or both, as discussed further below. In addition, the hydrate generator 214 may include long sections of piping in order to allow enough flow time for adequate conversion of the gas stream 206 into the hydrate slurry 222. In various embodiments, the water stream 220 and the gas stream 206 may be injected into the hydrate generator 214 proportionally to maintain a dispersed bubble flow regime. As used herein, the term "bubble flow regime" refers to a multiphase fluid flow regime in which a gas phase is distributed as bubbles throughout a liquid phase.

In various embodiments, the hydrate slurry 222 may be water continuous and highly flowable. The hydrate slurry 222 may be formed in a water continuous system rather than an oil continuous system due to the lack of adhesive forces between hydrate particles or, more specifically, water droplets which occurs in the oil continuous regime. Further, in various embodiments, the hydrate slurry 222 may include cold flow hydrates.

According to embodiments disclosed herein, the hydrate slurry 222 is formed rapidly. Such a rapid formation of the hydrate slurry 222 may concentrate the gas stream 206, reducing the overall gas void fraction. Once the gas void fraction has been lowered, the hydrate slurry 222 can be boosted up to the reservoir injection pressure using a pump 224. The pump 224 may be a multiphase pump (MPP) or, if the gas void fractions are low enough, a single phase pump (SPP).

Once the hydrate slurry 222 passes through the pump 224, the hydrate slurry 222 may be transported to a reservoir 226 via an injection well (not shown). As the hydrate slurry 222 travels down the wellbore of the injection well to the reservoir 226, the heat from the reservoir 226 will begin to dissociate the hydrate slurry 222, releasing the gas stream 206, and providing simultaneous water and gas injection. In some embodiments, depending on the thermodynamics and thermal heat loads of the reservoir 226, a heater, or heat exchanger, (not shown) is placed after the pump 224 to aid in the dissociation of the hydrate slurry 222. In other embodiments, a thermodynamic hydrate inhibitor (THI) injection line (not shown) is placed after the pump 224. The THI injection line may inject THI into the hydrate slurry 222, which may aid in the dissociation of the hydrate slurry 222.

Figure 3:
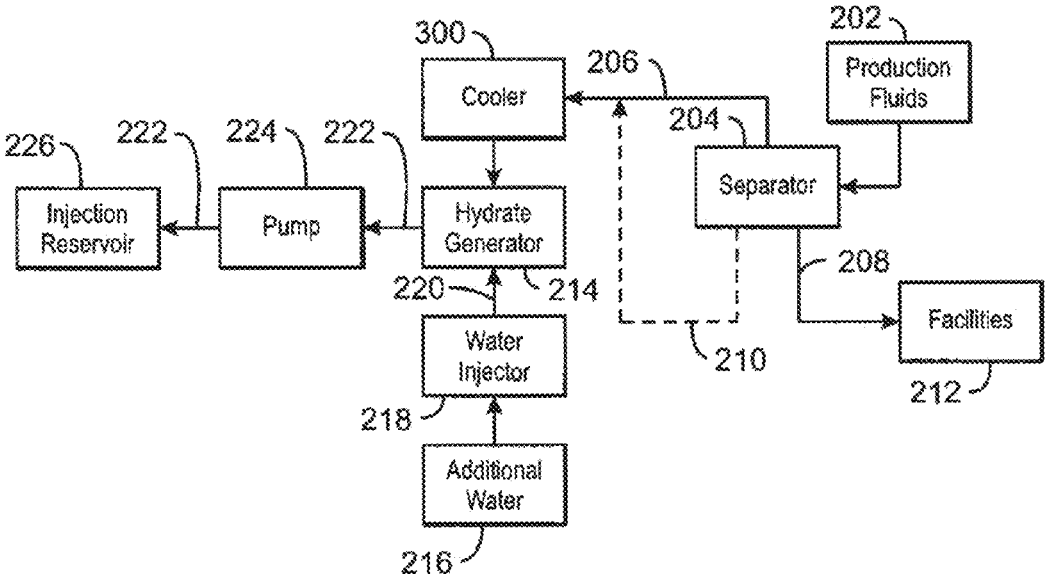
FIG. 3 is a block diagram of the SWAG injection system with the addition of a cooler for lowering the temperature of the gas stream and the water from the production fluids.

FIG. 3 is a block diagram of the SWAG injection system 200 with the addition of a cooler 300 for lowering the temperature of the gas stream 206 and the water 210 from the production fluids 202. Like numbered items are as described with respect to FIG. 2. The cooler 300 may be used to aid in the cooling of the gas stream 206 and the water 210 if the production fluids 202 are too hot for the generation of the hydrate slurry 222. The cooler 300 may be any type of heat exchanger that is configured to cool a fluid to temperatures that are conducive to the formation of hydrates.

Once the temperature of the gas stream 206 and the water 210 has been lowered within the cooler 300, the gas stream 206 and the water 210 may be sent to the hydrate generator 214 as a partially mixed stream 302. Within the hydrate generator 214, the partially mixed stream 302 and the water 220 may be mixed together in order to form the hydrate slurry 222. The hydrate slurry 222 may then be sent through the pump 224 and injected into the reservoir 226, as discussed above with respect to FIG. 2.

Figure 4:
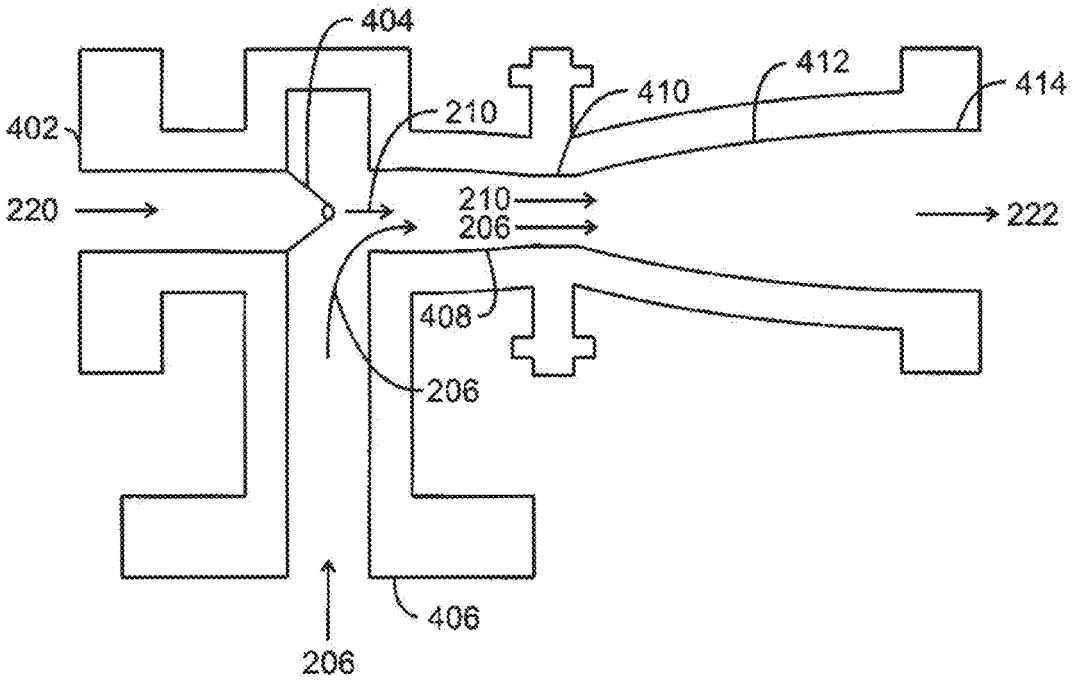
FIG. 4 is a schematic of a jet pump that may be used for the generation of the hydrate slurry.

FIG. 4 is a schematic of a jet pump 400 that may be used for the generation of the hydrate slurry 222. Like numbered items are as described with respect to FIG. 2. In various embodiments, the hydrate generator 214 may be, or may include, the jet pump 400. The water stream 220 may be injected into the jet pump 400 via a water inlet 402. In some embodiments, the water inlet 402 may include a nozzle 404 that is configured to increase the velocity of the water stream 220 as it enters the jet pump 400. In addition, the water stream 220 may act as the motive fluid within the jet pump 400. In other words, the water stream 220 may provide the driving pressure for the movement of fluids through the jet pump 400.

In addition, the gas stream 206 may be injected into the jet pump 400 via a gas inlet 406. In some embodiments, the gas stream 206 may be entrained in the motive fluid, i.e., the water stream 220, due to the pressure characteristics of the motive fluid. The gas stream 206 may also act as the hydrate-forming constituent in the formation of the hydrate slurry 222 within the jet pump 400.

The water stream 220 and the gas stream 206 may flow through a converging inlet nozzle 408 within the jet pump 400. The converging inlet nozzle 408 may convert the pressure energy of the water stream 220, i.e., the motive fluid, to velocity energy. This may create a low pressure zone towards the end of the converging inlet nozzle 408, which draws in and entrains the gas stream 206, i.e., the suction fluid. Thus, towards the end of the converging inlet nozzle 408, the water stream 220 and the gas stream 206 are in close contact with one another, as shown in FIG. 4, and may be partially mixed.

The jet pump 400 may also include a throat 410 that is located at the end of the converging inlet nozzle 408, immediately in front of a diverging outlet diffuser 412. As the water stream 220 and the gas stream 206 pass through the throat 410 of the jet pump 400, the pressure of the water stream 220 and the gas stream 206 may be slightly increased, and the velocity of the water stream 220 and the gas stream 206 may be slightly decreased. In addition, the water stream 220 and the gas stream 206 may begin to turbulently mix with one another.

From the throat 410, the water stream 220 and the gas stream 206 may flow into the diverging outlet diffuser 412. Within the diverging outlet diffuser 412, the water stream 220 and the gas stream 206 may be turbulently mixed to form the hydrate slurry 222. In addition, the hydrate slurry 222 may expand within the diverging outlet diffuser 412, resulting in an increase in pressure and a reduction in velocity. This may result in the recompression of the hydrate slurry 222 through the conversion of the velocity energy of the hydrate slurry 222 back into pressure energy.

Once the hydrate slurry 222 passes through the diverging outlet diffuser 412, the hydrate slurry 222 may be flowed out of the jet pump 400 via an outlet 414. In various embodiments, the hydrate slurry 222 may then be flowed through the pump 224 and injected into the reservoir 226, as discussed with respect to FIG. 2.

Figure 5:
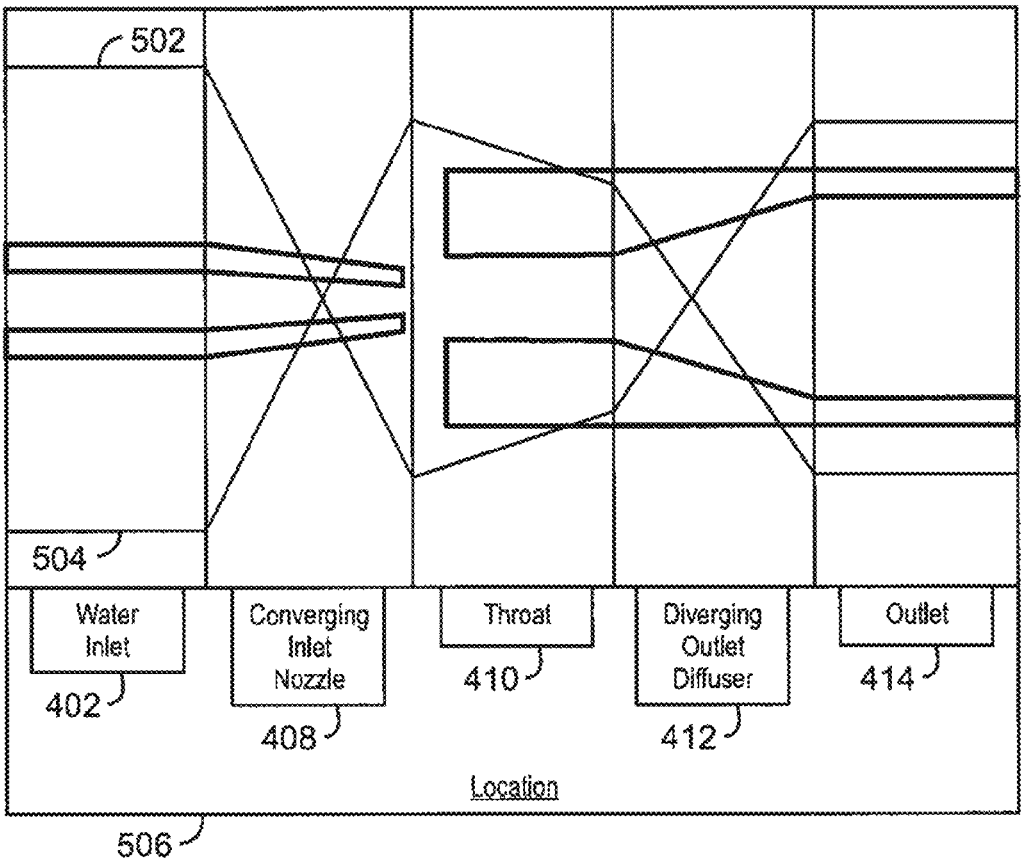
FIG. 5 is a graph showing the expected conditions within the jet pump during the generation of the hydrate slurry.

FIG. 5 is a graph 500 showing the expected conditions within the jet pump 400 during the generation of the hydrate slurry. Like numbered items are as described with respect to FIGS. 2 and 4. The graph 500 shows power fluid pressure 502, e.g., the pressure of the water stream 220, as well as power fluid velocity 504, e.g., the velocity of the water stream 220, within the jet pump 400. The water stream 220 may be referred to as the "power fluid" since it is the motive fluid that provides the driving pressure. The power fluid pressure 502 and the power fluid velocity 504 are evaluated at different locations 506 along the path of the water stream 220 and the gas stream 206 through the jet pump 400. The locations 506 at which the power fluid pressure 502 and the power fluid velocity 504 are evaluated include the water inlet 402, the converging inlet nozzle 408, the throat 410, the diverging outlet diffuser 412, and the outlet 414.

Within the water inlet 402, the power fluid pressure 502 and the power fluid velocity 504 may remain constant, or approximately constant, since the radius of the water inlet 402 may be constant. However, in some embodiments, the power fluid velocity 504 may begin to increase at the nozzle 404 that is located at the end of the water inlet 402. Thus, the power fluid pressure 502 may correspondingly decrease.

As the water stream 220 and the gas stream 206 flow through the converging inlet nozzle 408, the power fluid velocity 504 may increase linearly, or approximately linearly, due to the reduction in radius of the jet pump 400 at the converging inlet nozzle 408. In addition, the power fluid pressure 502 may decrease linearly, or approximately linearly, due to the Venturi effect. According to the Venturi effect, the velocity of a fluid increases as the cross-sectional area of the pipe in which it is flowing decreases, and the pressure of the fluid correspondingly decreases.

Within the throat 410 of the jet pump 400, the power fluid pressure 502 may be slightly increased, and the power fluid velocity 504 may be slightly decreased. In addition, turbulent mixing of the water stream 220 and the gas stream 206 may begin to occur within the throat 410.

As the water stream 220 and the gas stream 206 flow through the diverging outlet diffuser 412, the power fluid velocity 504 may decrease as the radius of the diverging outlet diffuser 412 increases. The power fluid pressure 502 may correspondingly increase. Turbulent mixing of the water stream 220 and the gas stream 206 may occur within the diverging outlet diffuser 412, resulting in the formation of the hydrate slurry 222. The hydrate slurry 222 may flow out of the jet pump 400 through the outlet 414, in which both the power fluid pressure 502 and the power fluid velocity 502 may remain constant, or approximately constant.

Figure 6:
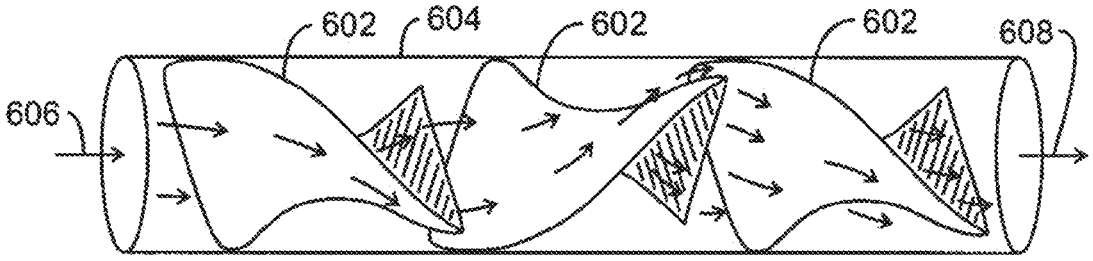
FIG. 6 is a schematic of a static mixer that may be used for the generation of the hydrate slurry.

FIG. 6 is a schematic of a static mixer 600 that may be used for the generation of the hydrate slurry 222. Like numbered items are as described with respect to FIG. 2. In various embodiments, the hydrate generator 214 may be, or may include, the static mixer 600. For example, the static mixer 600 may be located after the jet pump 500, discussed with respect to FIG. 5, to further increase mixing and hydrate formation. The static mixer 600 may include static mixer elements 602 contained within a cylindrical tube 604. The static mixer elements 602 may include a series of baffles that are made from metal or a variety of plastics. The static mixer elements 602 may also be helically-shaped, allowing for simultaneous flow division and radial mixing of fluids.

The water stream 220 and the gas stream 206 may be flowed into one end of the static mixer 600, as indicated by arrow 606. As the water stream 220 and the gas stream 206 flow through the static mixer 600, the flow of the water stream 220 and the gas stream 206 may be divided into multiple channels using the static mixer elements 602. In addition, the turbulent flow that is imparted by the static mixer elements 602 may cause the water stream 220 and the gas stream 206 to be radially mixed. Such mixing may result in the generation of the hydrate slurry 222. The hydrate slurry 222 may then be flowed out of the static mixer 600, as indicated by arrow 608.

Figure 7:
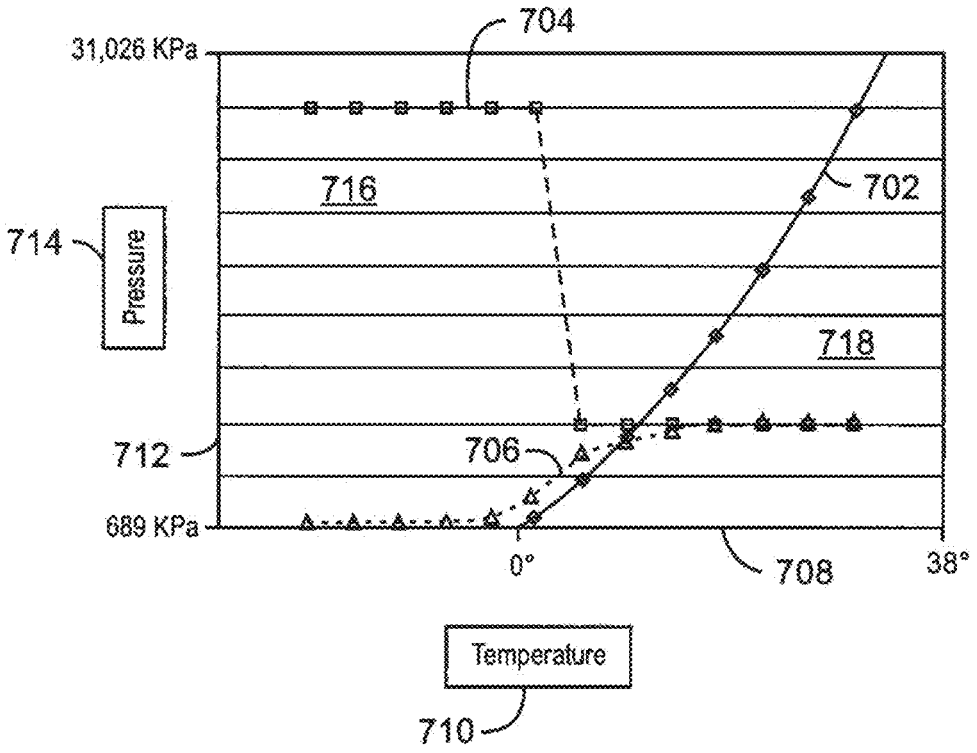
FIG. 7 is a graph showing an equilibrium curve for hydrate formation.

FIG. 7 is a graph 700 showing an equilibrium curve 702 for hydrate formation. The graph 700 also shows a velocity curve 704 and a gas void fraction curve 706 that correspond to the equilibrium curve 702. The x-axis 708 of the graph 700 represents temperature 710 in ° C., while the y-axis 712 of the graph 700 represents pressure 714 in kPa.

Hydrates can form in the area 716 to the left of the equilibrium curve 702, while hydrates cannot form in the area 718 to the right of the equilibrium curve 702. Thus, hydrates may form more readily at low temperatures, such as at a temperature 710 of 0° C. or less. However, as the temperature 710 increases, the pressure 714 at which hydrates will form correspondingly increases. For example, hydrates may form at around 16° C. and 6895 kPa, as well as at around 38° C. and 31,026 kPa.

Hydrate formation may also correspond to the velocity of the fluids and the gas void fraction of the fluids. For example, as shown by the velocity curve 704, the velocity at which hydrates may form may be relatively high as long as the temperature 710 is at or below 0° C. However, once the temperature 710 increases above 0° C., hydrates may form more readily at lower velocities. In addition, the gas void fraction may increase as the formation of hydrates decreases, as shown by the gas void fraction curve 706. This is due to the fact that the rapid formation of hydrates concentrates the gas, reducing the overall gas void fraction.

Method for Injecting Hydrate Slurry into Reservoir

Figure 8:
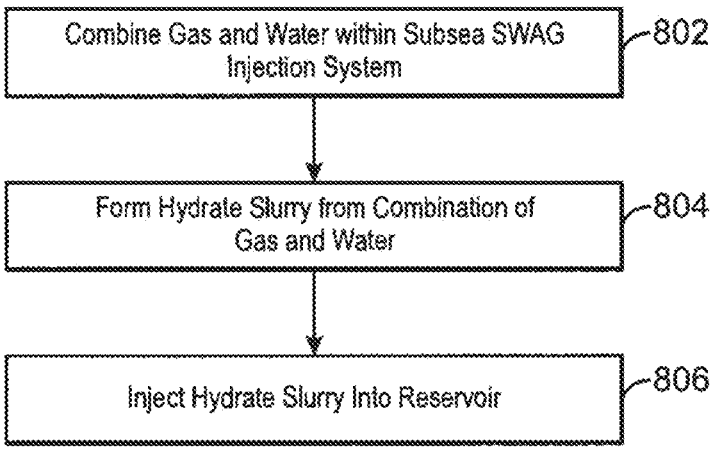
FIG. 8 is a process flow diagram showing a method for injecting a hydrate slurry into a reservoir.

FIG. 8 is a process flow diagram showing a method 800 for injecting a hydrate slurry into a reservoir. The method 800 may be implemented using a subsea SWAG injection system, and may be used to maintain a degree of pressure within the reservoir. In various embodiments, the method 800 may be implemented using the SWAG injection system 200 discussed with respect to FIGS. 2 and 3.

The method begins at block 802, at which gas and water are combined within the subsea SWAG injection system. The subsea SWAG injection system may include a subsea separation system that is configured to separate gas from production fluids, such as production fluids leaving a wellhead or manifold. In addition, the subsea separation system may separate some amount of water from the production fluids. The gas and separated water may then be flowed into a hydrate generator. In some embodiments, a cooler, or heat exchanger, may be used to decrease the temperature of the gas and the separated water from the production fluids before the gas and water are flowed into the hydrate generator.

In addition, water from a number of other sources may be injected into the hydrate generator. For example, local seawater that has been treated to extract oxygen and bacteria may be injected into the hydrate generator. Water may be obtained from an aquifer. Produced water or seawater may also be processed at a facility and transported to the subsea SWAG injection system. In some embodiments, the injection of such water may be accomplished by the subsea SWAG injection system using a water injector.

At block 804, the hydrate slurry may be formed from the combination of the gas and the water. The hydrate generator may be configured to form the hydrate slurry from the gas and the water. This may be accomplished through a turbulent mixing process. In various embodiments, the hydrate slurry may be created by combining the gas and water in a turbulent bubble flow regime. Further, in some embodiments, a jet pump, such as the jet pump 400 discussed with respect to FIG. 4, or any number of static mixers, such as the static mixer 600 discussed with respect to FIG. 6, may be used to generate the hydrate slurry.

In various embodiments, the hydrate slurry that is generated at block 804 is water continuous. In addition, the hydrate slurry may have a gas void fraction that is below 10%. Such a low gas void fraction may allow for the use of pumps to boot a pressure of the hydrate slurry to a pressure of a reservoir, as discussed further below.

At block 806, the hydrate slurry may be injected into a reservoir. The hydrate slurry may be injected into the reservoir via an injection well. The injection of the hydrate slurry into the reservoir may result in the maintenance of, or increase in, a pressure within the reservoir.

In some embodiments, a pump is used to increase the pressure of the hydrate slurry within the injection well before the hydrate slurry is injected into the reservoir. The hydrate slurry may also be flowed through a heat sink before the hydrate slurry is injected into the reservoir. In addition, a thermodynamic hydrate inhibitor may be added to the hydrate slurry before the hydrate slurry is injected into the reservoir. The thermodynamic hydrate inhibitor may aid in the dissociation of the water and the gas within the hydrate slurry once the hydrate slurry has been injected into the reservoir.

FIG. 8 is not intended to indicate that the steps of method 800 are to be executed in any particular order, or that all of the steps of the method 800 are to be included in every case. Further, any number of additional steps may be included within the method 800, depending on the specific application. For example, in various embodiments, hydrocarbons that are separated from the gas within the subsea separation system are flowed to a facility for further processing.

Figure 9:
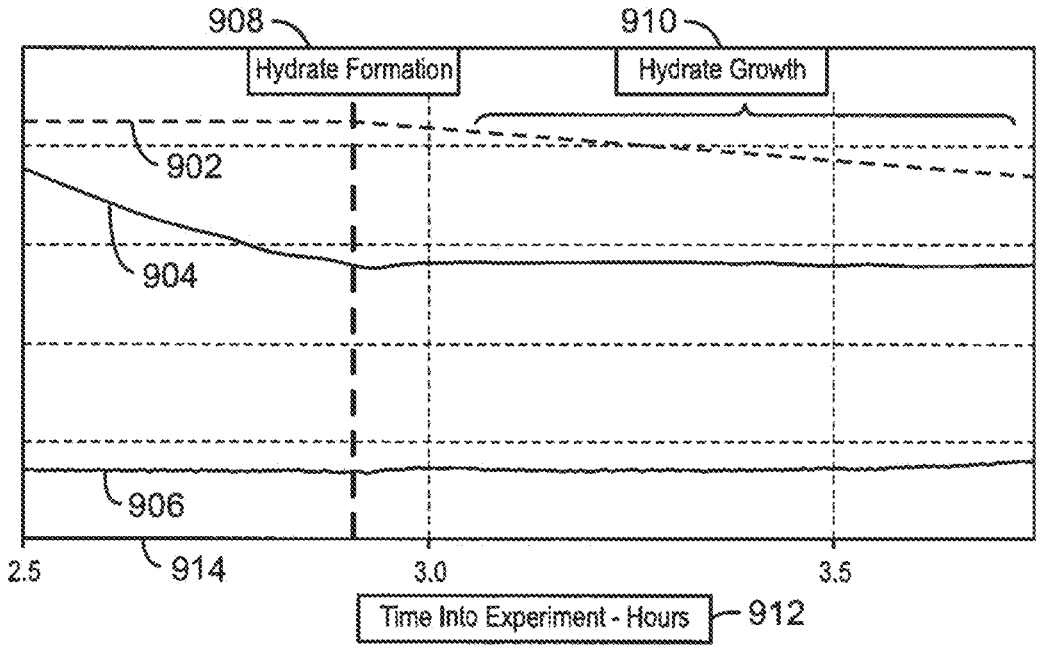
FIG. 9 is a graph showing results of a hydrate formation experiment.

FIG. 9 is a graph 900 showing results of a hydrate formation experiment. More specifically, the graph 900 shows experimental evidence of hydrate transportability in a water continuous system. The experiment was performed in a 4" diameter flow loop using water with a 50% gas void fraction of methane gas. The flow loop pump was set to maintain a fluid velocity of 1.5 m/s.

The graph 900 shows accumulator volume 902, loop temperature 904, and loop pressure drop 906 during hydrate formation 908 and hydrate growth 910. The accumulator volume 902, loop temperature 904, and loop pressure drop 906 are reported as a function of time 912 into the experiment in hours, as indicated by the x-axis 914 of the graph 900. As shown in FIG. 9, upon hydrate formation 908 and subsequent hydrate growth 910, the loop pressure drop 906 remained approximately constant. An increase in loop pressure drop 906 would indicate a blockage.

For the formation of hydrates, it is generally desirable to maintain a fluid velocity and gas void fraction such that a dispersed bubble flow is achieved. In addition, it is generally desirable for the concentration of hydrates in the water phase to not exceed 15%-20%. The concentration of the hydrates in the water phase may determine the amount of water to be used to attain a desired gas injection rate.

The above-described embodiments of the invention are intended to be examples only. Alterations, modifications, and variations can be effected to the particular embodiments by those of ordinary skill in the art without departing from the scope of the invention, which is defined solely by the claims appended hereto.

Embodiments

Embodiments of the invention may include any combinations of the methods and systems shown in the following numbered paragraphs. This is not to be considered a complete listing of all possible embodiments, as any number of variations can be envisioned from the description above.

1. A method for injecting a hydrate slurry into a reservoir, including:

combining gas and water within a subsea simultaneous water and gas (SWAG) injection system;

forming a hydrate slurry from the gas and the water; and injecting the hydrate slurry into a reservoir.

2. The method of paragraph 1, wherein injecting the hydrate slurry into the reservoir results in a maintenance of pressure within the reservoir.

3. The method of any of paragraphs 1 or 2, wherein injecting the hydrate slurry into the reservoir results in an increase in pressure within the reservoir.

4. The method of any of paragraphs 1-3, including separating the gas from production fluids leaving a wellhead or a manifold via a separation system.

5. The method of any of paragraphs 1-4, wherein the water includes local seawater that is injected into the subsea SWAG injection system, and wherein the local seawater is treated before being injected to extract oxygen and bacteria.

6. The method of any of paragraphs 1-5, including processing the water at a facility and transporting the water to the subsea SWAG injection system.

7. The method of any of paragraphs 1-6, including forming the hydrate slurry by combining the water and the gas in a turbulent bubble flow regime using a jet pump.

8. The method of any of paragraphs 1-7, including forming the hydrate slurry by combining the water and the gas in a turbulent bubble flow regime using a static mixer.

9. The method of any of paragraphs 1-8, wherein the hydrate slurry includes a gas void fraction below 10%.

10. A system for maintaining pressure within a reservoir using a subsea simultaneous water and gas (SWAG) injection system, including:

a subsea separation system configured to:

separate gas from production fluids; and flow the gas into a hydrate generator;

a water injector configured to inject water into the hydrate generator;

the hydrate generator configured to form a hydrate slurry from the gas and the water; and an injection well configured to inject the hydrate slurry into a reservoir.

11. The system of paragraph 10, including a cooler for decreasing a temperature of the gas and separated water from the production fluids before the gas and the separated water flow into the hydrate generator.

12. The system of any of paragraphs 10 or 11, wherein the subsea separation system is configured to flow hydrocarbons that are separated from the gas to a facility.

13. The system of any of paragraphs 10-12, including a pump configured to increase a pressure of the hydrate slurry within the injection well.

14. The system of any of paragraphs 10-13, including a heat exchanger configured to decrease a temperature of the gas before the gas is flowed into the hydrate generator.

15. The system of any of paragraphs 10-14, including a heat exchanger configured to decrease a temperature of the water before the water is injected into the hydrate generator.

16. The system of any of paragraphs 10-15, wherein the water includes local seawater from which oxygen and bacteria have been extracted.

17. The system of any of paragraphs 10-16, wherein the water has been processed at a facility.

18. The system of any of paragraphs 10-17, wherein the hydrate slurry is water continuous.

19. The system of any of paragraphs 10-18, wherein the hydrate generator is configured to create the hydrate slurry by combining the water and the gas in a turbulent bubble flow regime using a jet pump or static mixers, or any combinations thereof.

20. A method for maintaining pressure within a reservoir using a water continuous hydrate slurry that is generated in a subsea environment, including:

combining gas and water within a hydrate generator to generate the water continuous hydrate slurry in the subsea environment; and injecting the water continuous hydrate slurry into the reservoir to effect a maintenance of pressure within the reservoir.

21. The method of paragraph 20, including separating the gas from production fluids leaving a wellhead or a manifold via a subsea separation system.

22. The method of any of paragraphs 20 or 21, including flowing the water continuous hydrate slurry through a heat sink before injecting the water continuous hydrate slurry into the reservoir.

23. The method of any of paragraphs 20-22, including adding a thermodynamic hydrate inhibitor to the water continuous hydrate slurry before injecting the water continuous hydrate slurry into the reservoir, wherein the thermodynamic hydrate inhibitor aids in a dissociation of the water continuous hydrate slurry.

24. The method of any of paragraphs 20-23, wherein injecting the water continuous hydrate slurry into the reservoir includes increasing a pressure of the water continuous hydrate slurry using a pump.

25. The method of any of paragraphs 20-24, wherein combining the gas and the water within the hydrate generator includes turbulently mixing the gas and the water using a jet pump or static mixers, or any combinations thereof.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A method for injecting a hydrate slurry into a reservoir, comprising:

combining gas and water within a subsea simultaneous water and gas (SWAG) injection system;

forming a hydrate slurry from the gas and the water; and injecting the hydrate slurry into a reservoir.

2. The method of claim 1, wherein injecting the hydrate slurry into the reservoir results in a maintenance of pressure within the reservoir.

3. The method of claim 1, wherein injecting the hydrate slurry into the reservoir results in an increase in pressure within the reservoir.

4. The method of claim 1, comprising separating the gas from production fluids leaving a wellhead or a manifold via a separation system.

5. The method of claim 1, wherein the water comprises local seawater that is injected into the subsea SWAG injection system, and wherein the local seawater is treated before being injected to extract oxygen and bacteria.

6. The method of claim 1, comprising processing the water at a facility and transporting the water to the subsea SWAG injection system.

7. The method of claim 1, comprising forming the hydrate slurry by combining the water and the gas in a turbulent bubble flow regime using a jet pump.

8. The method of claim 1, comprising forming the hydrate slurry by combining the water and the gas in a turbulent bubble flow regime using a static mixer.

9. The method of claim 1, wherein the hydrate slurry comprises a gas void fraction below 10%.

10. A system for maintaining pressure within a reservoir using a subsea simultaneous water and gas (SWAG) injection system, comprising:

a subsea separation system configured to:

separate gas from production fluids; and flow the gas into a hydrate generator;

a water injector configured to inject water into the hydrate generator;

the hydrate generator configured to form a hydrate slurry from the gas and the water; and an injection well configured to inject the hydrate slurry into a reservoir.

11. The system of claim 10, comprising a cooler for decreasing a temperature of the gas and separated water from the production fluids before the gas and the separated water flow into the hydrate generator.

12. The system of claim 10, wherein the subsea separation system is configured to flow hydrocarbons that are separated from the gas to a facility.

13. The system of claim 10, comprising a pump configured to increase a pressure of the hydrate slurry within the injection well.

14. The system of claim 10, comprising a heat exchanger configured to decrease a temperature of the gas before the gas is flowed into the hydrate generator.

15. The system of claim 10, comprising a heat exchanger configured to decrease a temperature of the water before the water is injected into the hydrate generator.

16. The system of claim 10, wherein the water comprises local seawater from which oxygen and bacteria have been extracted.

17. The system of claim 10, wherein the water has been processed at a facility.

18. The system of claim 10, wherein the hydrate slurry is water continuous.

19. The system of claim 10, wherein the hydrate generator is configured to create the hydrate slurry by combining the water and the gas in a turbulent bubble flow regime using a jet pump or static mixers, or any combinations thereof.

20. A method for maintaining pressure within a reservoir using a water continuous hydrate slurry that is generated in a subsea environment, comprising:

combining gas and water within a hydrate generator to generate the water continuous hydrate slurry in the subsea environment; and injecting the water continuous hydrate slurry into the reservoir to effect a maintenance of pressure within the reservoir.

21. The method of claim 20, comprising separating the gas from production fluids leaving a wellhead or a manifold via a subsea separation system.

22. The method of claim 20, comprising flowing the water continuous hydrate slurry through a heat sink before injecting the water continuous hydrate slurry into the reservoir.

23. The method of claim 20, comprising adding a thermodynamic hydrate inhibitor to the water continuous hydrate slurry before injecting the water continuous hydrate slurry into the reservoir, wherein the thermodynamic hydrate inhibitor aids in a dissociation of the water continuous hydrate slurry.

24. The method of claim 20, wherein injecting the water continuous hydrate slurry into the reservoir comprises increasing a pressure of the water continuous hydrate slurry using a pump.

25. The method of claim 20, wherein combining the gas and the water within the hydrate generator comprises turbulently mixing the gas and the water using a jet pump or static mixers, or any combinations thereof.

* * * * *